US007846374B2

(12) United States Patent
Hovanec

(10) Patent No.: US 7,846,374 B2
(45) Date of Patent: Dec. 7, 2010

(54) BLOWING GASES IN ELECTROBLOWING PROCESS

(75) Inventor: Joseph Brian Hovanec, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 1128 days.

(21) Appl. No.: 10/982,572

(22) Filed: Nov. 5, 2004

(65) Prior Publication Data

US 2006/0097431 A1 May 11, 2006

(51) Int. Cl.
*D01D 10/00* (2006.01)
*D04H 3/02* (2006.01)
*D06M 10/00* (2006.01)

(52) U.S. Cl. ..... 264/465; 264/85; 264/103

(58) Field of Classification Search ..... 264/85, 264/103, 465

See application file for complete search history.

(56) References Cited

U.S. PATENT DOCUMENTS 7,297,305 B2 11/2007 Andrady et al.

2005/0073075 A1* 4/2005 Chu et al. ..... 264/465

FOREIGN PATENT DOCUMENTS

| | | | |
|---|---|---|---|
| WO | WO 03/015927 | A1 | 2/2003 |
| WO | WO 03/080905 | A1 | 10/2003 |
| WO | WO 2005/026398 | A2 | 3/2005 |
| WO | WO 2005/033381 | A2 | 4/2005 |

* cited by examiner

*Primary Examiner*—Leo B Tentoni

(57) ABSTRACT

The present invention is directed to a method for preparing a nanofiber web by feeding a polymer solution, which has at least one polymer dissolved in at least one flammable solvent to a spinning nozzle, discharging the polymer solution from the spinning nozzle into a blowing gas or gas mixture that will not support combustion, wherein the blowing gas exits a jet at a lower end of the spinning nozzle, to form polymer nanofibers and collecting the polymer nanofibers on a collector under the spinning nozzle, wherein an applied high voltage differential is maintained between the spinneret and the collector.

11 Claims, 1 Drawing Sheet

BLOWING GASES IN ELECTROBLOWING PROCESS

This invention relates to a method of forming a polymeric nanofiber web via electro-blown spinning or electro-blowing. The nanofiber web of the invention can be incorporated in composite fabrics suited for use in apparel, wipes, hygiene products, filters and surgical gowns and drapes.

Synthetic polymers have been fashioned into very small diameter fibers using various processes including melt spinning, flash spinning, solution blowing, melt blowing, electrostatic spinning and electro-blowing. Webs made from these very small diameter fibers are useful as liquid barrier materials and filters. Often they are combined with other stronger webs into composites for additional strength to meet the needs of the product end use.

In those spinning processes that utilize a flammable solvent in a polymer solution and the solvent comes into contact with air, steps must be taken to minimize the chance of starting and propagating a fire. In the case of electro-blowing, where a flammable solvent from the polymer solution comes into contact with air in the presence of a high voltage charge, there is a need to minimize the fire potential. This is especially important when scaling up from small laboratory processes to large scale commercial production.

SUMMARY OF THE INVENTION

A first embodiment of the present invention is directed to a method for preparing a nanofiber web comprising feeding a polymer solution, which comprises at least one polymer dissolved in at least one flammable solvent to a spinning nozzle, discharging the polymer solution from the spinning nozzle into a blowing gas or gas mixture that will not support combustion, wherein the blowing gas exits a jet at a lower end of the spinning nozzle, to form polymer nanofibers, and collecting the polymer nanofibers on a collector under the spinning nozzle, wherein an applied high voltage differential is maintained between the spinneret and the collector.

DETAILED DESCRIPTION OF THE INVENTION

Figure 1:
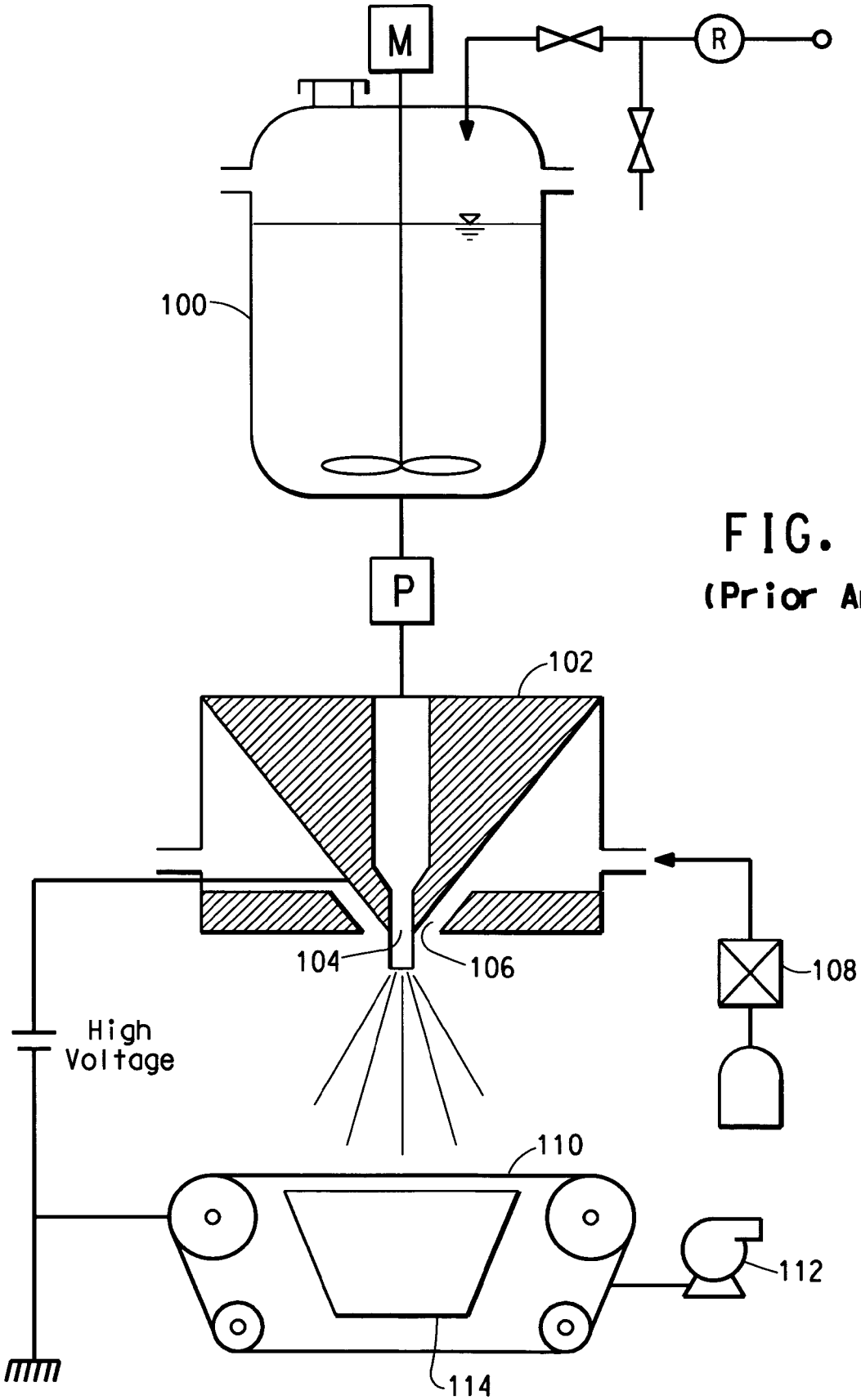
FIG. 1 (Prior Art)
FIG. 1 is a schematic diagram of a prior art electro-blowing apparatus for conducting the process of the present invention.

This invention is directed towards an improvement to the method for preparing a nanofiber web using electro-blown spinning (or "electro-blowing") as described in International Publication Number WO2003/080905 (U.S. Ser. No. 10/477,882), which is hereby incorporated by reference. This prior art electro-blowing method comprises feeding a solution of a polymer in a solvent to a spinning nozzle to which a high voltage is applied, while compressed air is directed toward the polymer solution in a blowing gas stream as it exits the nozzle to form nanofibers and collecting the nanofibers into a web on a grounded collector under vacuum.

According to the present invention, the compressed air is replaced with a gas or gas mixture that will not support combustion. The presence of molecular oxygen gas in air would support combustion when a flammable solvent is used, a situation which is exacerbated by the presence of a high voltage potential difference between the spinning nozzle and the collector. If any of a variety of process parameters are not adequately controlled, an electrical arc can occur, providing an ignition source. By replacing the blowing air with gases that will not support combustion, the potential for a fire is reduced.

"Nanofibers" means fibers having diameters varying from a few tens of nanometers up to several hundred nanometers, but generally less than one micrometer.

FIG. 1 shows a diagram of a nanofiber web preparing apparatus of the invention for illustrating a nanofiber web preparing process.

A storage tank 100 prepares a polymer solution from dissolution of one or more polymers in one or more solvents. Polymers available for the invention are not restricted to thermoplastic resins, but may utilize most synthetic resins such as thermosetting resins. Examples of the available polymers may include polyimide, nylon, polyaramid, polybenzimidazole, polyetherimide, polyacrylonitrile, poly(ethylene terephthalate), polypropylene, polyaniline, poly(ethylene oxide), poly(ethylene naphthalate), poly(butylene terephthalate), styrene butadiene rubber, polystyrene, poly(vinyl chloride), poly(vinyl alcohol), poly(vinylidene fluoride), poly(vinyl butylene) and copolymer or derivative compounds thereof.

The polymer solution is prepared by selecting a solvent that will dissolve the polymer. Suitable solvents include but are not limited to flammable solvents such as tetrahydrofuran, N-dimethylformamide, dimethylacetamide, acetone and methyl ethyl ketone. Although dissolving most of the polymers may not require any specific temperature ranges, heating may be needed for assisting the dissolution reaction. The polymer solution can be mixed with additives, including any resin compatible with an associated polymer, plasticizer, ultraviolet ray stabilizer, crosslinking agent, curing agent, reaction initiator, etc. Although the apparatus shown in FIG. 1 adopts a compression arrangement that forcibly blows compressed gas into the storage tank 100 in order to force the polymer solution from the storage tank 100, any known means for forcing the polymer solution from the storage tank 100 can be utilized.

The polymer solution is discharged from the storage tank 100 via a spinning nozzle 104 of a spinneret 102 which is electrically insulated and applied with a high voltage. After optionally heating in a gas heater 108, compressed gas comprising a gas or gas mixture (the "blowing gas") that will not support combustion is injected via gas nozzles 106 disposed in sides of the spinning nozzle 104 wherein the gas contacts the polymer solution after the polymer solution exits the spinneret. The polymer solution discharged from the spinning nozzle 104 of the spinneret 102 forms nanofibers that are collected in the form of a web on a collector 110 under the spinning nozzle 104. The collector 110 is grounded, and designed to draw gas through a gas collecting vessel 114, so that gas is drawn through a high voltage region between the spinning nozzle 104 and the collector 110, and by suction of a blower 112. Alternatively, the spinneret 102 can be grounded and the collector 110 can be applied with a high voltage. Also, in place of a collector 110 utilizing suction, an electrostatic charge can be applied to the web to pin it to the collector without the need for suction under the collector. Gas drawn in by the blower 112 contains solvent and thus a Solvent Recovery System (SRS, not shown) is preferably included to recover solvent while recycling gas through the apparatus. The SRS may adopt a well-known construction.

One drawback to the method of the prior art is that when air, which comprises about 21 vol. % molecular oxygen, is used as a blowing gas, a possibility of fire or explosion exists. This is especially a problem due to the presence of a possible ignition source, which can exist if electrical arcing occurs between the spinning nozzle and the collector. The problem is exacerbated when the air is heated, which can act to volatilize the solvent and form flammable and/or explosive vapors. Due to the high polymer solution throughput rate of the electro-blowing process, which can range from 0.1 to 5 mL/min per hole of the spinning nozzle, considerable volumes of vaporized solvent can be created, which can result in a quite hazardous environment if the vaporized solvent concentration reaches or exceeds the lower explosive limit (LEL) in air.

In one embodiment of the present invention, the blowing gas is selected to be a gas or gas mixture which will not support combustion, such as nitrogen, argon, helium, carbon dioxide, hydrocarbons, halocarbons, halohydrocarbons or mixtures thereof. In fact, it is possible to use as a blowing gas only enough of such gases to reduce the molecular oxygen content in the air surrounding the spinning nozzle/collector system to be below the ambient level of approximately 21 vol. %, such that the LEL of any particular flammable solvent in use is elevated to a point which exceeds the likely concentration of such solvent vapors in the reduced oxygen-containing atmosphere surrounding the spinning nozzle/collector system. That is, it is not necessary to completely blanket the spinning operation with the blowing gas, but only with a sufficient volume of such gas to reduce the molecular oxygen content to a safe level, below which combustion cannot be supported, which will vary depending upon the solvent in use and the temperature of the gas. To this end, it may be advantageous to dispose a gas probe within the spinning region between the spinning nozzle and the collector, to draw samples of gas from within that region into an oxygen analyzer to monitor the oxygen concentration within the region.

In another embodiment, the blowing gas itself can include low concentrations of molecular oxygen, so long as the mixture cannot support combustion.

In another embodiment, it would be advantageous to conduct the electro-blowing operation in a sealed system, such that the blowing gas is entirely contained within a sealed spinning vessel. The spinning vessel can be effectively purged of molecular oxygen, at least to a level that would be insufficient to support combustion. In such case, gases that would otherwise present a flammability hazard, such as hydrocarbons or even recycled solvent vapors, could be used as the blowing gas.

The calculation of safe concentrations of molecular oxygen content in the spinning environment is well within the level of skill in the art.

Various substrates can be arranged on the collector to collect and combine a nanofiber web spun on the substrate so that the combined fiber web is used as a high-performance filter, wipe and so on. Examples of the substrate may include various non-woven cloths such as melt-blown non-woven cloth, needle punching and spunlace non-woven cloth, woven cloth, knitted cloth, paper and the like, and can be used without limitations so long as a nanofiber layer can be added on the substrate.

The invention can be conducted under the following process conditions.

Voltage applied to the spinneret 102 is preferably in the range of about 1 to 300 kV and more preferably of about 10 to 100 kV. The polymer solution can be discharged under a pressure ranging from about 0.01 to 200 kg/cm$^2$ and in preferably about 0.1 to 20 kg/cm$^2$. This allows the polymer solution to be discharged by a large quantity in an adequate manner for mass production. The process of the invention can discharge the polymer solution with a high discharge rate of about 0.1 to 5 cc/min-hole as compared with electrostatic spinning methods.

Compressed gas injected via the gas nozzle 106 has a flow velocity of about 10 to 10,000 m/min and preferably of about 100 to 3,000 m/min. Gas temperature is preferably in the range of ambient temperature to about 300° C. and more preferably to about 100° C.

EXAMPLES

Hereinafter the present invention will be described in more detail in the following examples. An electro-blowing apparatus as described in International Publication Number WO2003/080905 and as is illustrated in FIG. 1, is used.

Example 1

A polymer solution having a concentration of 20 wt % polyacrylonitrile in N-dimethylformamide solvent is prepared and then is spun with the spinneret as shown in FIG. 1. A spinning pressure of 6 kg/cm$^2$ is applied. Nitrogen blowing gas is injected at the lower end of the spinning nozzle at about 1,000 m/min and the oxygen concentration in the spinning region is monitored, such that the flow velocity of nitrogen blowing gas is adjusted to reduce oxygen concentration within the spinning region to below the level at which combustion would be supported. Voltage is applied at 50 kV DC by charging the spinneret and grounding the collector. A web of polyacrylonitrile fibers is collected with an average fiber diameter <1,000 nm.

Example 2

A polymer solution having a concentration of 15 wt % poly(vinylidene fluoride) in acetone solvent is prepared and then is spun with the spinneret as shown in FIG. 1. A spinning pressure of 6 kg/cm$^2$ is applied. Argon blowing gas is injected at the lower end of the spinning nozzle at about 1,000 m/min and the oxygen concentration in the spinning region is monitored, such that the flow velocity of argon blowing gas is adjusted to reduce oxygen concentration within the spinning region to below the level at which combustion would be supported. Voltage is applied at 50 kV DC by charging the spinneret and grounding the collector. A web of poly(vinylidene fluoride) fibers is collected with an average fiber diameter <1,000 nm.

Example 3

The conditions set forth in Example 2 are reproduced, except that the blowing gas is a mixture of 5 vol. % oxygen/95 vol. % nitrogen. The mixed blowing gas is injected at the lower end of the spinning nozzle at 1,000 m/min and the oxygen concentration in the spinning region is monitored, such that the flow velocity of mixed blowing gas is adjusted to reduce oxygen concentration within the spinning region to below the level at which combustion would be supported. Voltage is applied at 50 kV DC by charging the spinneret and grounding the collector. A web of poly(vinylidene fluoride) fibers is collected with an average fiber diameter <1,000 nm.

What is claimed is:

1. A method for preparing a nanofiber web comprising feeding a polymer solution, which comprises at least one polymer dissolved in at least one flammable solvent to a spinning nozzle;

discharging the polymer solution from the spinning nozzle, at a polymer solution discharge rate of from 0.1 to 5 mL/min-hole, into a blowing gas mixture, wherein the blowing gas exits a jet at a lower end of the spinning nozzle into a spinning region defined between the spinning nozzle and a collector, and contacts the polymer solution in the spinning region after it exits the spinning nozzle, to form polymer nanofibers, and wherein the blowing gas comprises one or more inert gases that do not support combustion; and collecting the polymer nanofibers on the collector under the spinning nozzle, wherein an applied high voltage differential is maintained between the spinneret and the collector; and wherein the concentrations of solvent vapor and oxygen at any point in the spinning region are such that the concentration of solvent vapor does not exceed the lower explosive limit of the solvent in the spinning region at that point.

2. The method of claim 1, wherein the blowing gas is selected from the group of nitrogen, argon, helium, carbon dioxide, hydrocarbons, halocarbons, halohydrocarbons and mixtures thereof.

3. The method of claim 1, wherein the polymer is selected from the group of polyimide, nylon, polyaramid, polybenzimidazole, polyetherimide, polyacrylonitrile, poly(ethylene terephthalate), polypropylene, polyaniline, poly(ethylene oxide), poly(ethylene naphthalate), poly(butylene terephthalate), styrene butadiene rubber, polystyrene, poly(vinyl chloride), poly(vinyl alcohol), poly(vinylidene fluoride), poly(vinyl butylene) and copolymer or derivative compounds thereof.

4. The method of claim 3, wherein the flammable solvent is selected from the group of tetrahydrofuran, N-dimethylformamide, dimethylacetamide, acetone and methyl ethyl ketone.

5. The method of claim 1, wherein a high voltage is applied to the spinning nozzle and is about 1 to about 300 kV.

6. The method of claim 1, wherein a high voltage is applied to the collector and is about 1 to about 300 kV.

7. The method of claim 1, wherein the polymer solution is compressively discharged through the spinning nozzle under a discharge pressure in the range of about 0.01 to about 200 $kg/cm^2$.

8. The method of claim 1, wherein the blowing gas is injected at a flow velocity of about 10 to about 10,000 m/min and a temperature from about ambient to about 300° C.

9. The method of claim 4, wherein the blowing gas is injected at a temperature from about ambient to about 300° C.

10. The method of claim 1, wherein the collector has a substrate disposed thereon for collecting the nanofibers deposited in the form of a web on the substrate.

11. The method of claim 2, wherein the flow velocity of the blowing gas is adjusted to reduce the oxygen concentration in the spinning region surrounding the spinning nozzle/collector system to a level too low to support combustion of said solvent.

* * * * *